US005862521A

United States Patent [19]

van Marwijk et al.

[11] Patent Number: 5,862,521

[45] Date of Patent: Jan. 26, 1999

[54] GLOVE FOR PROTECTING THE HAND AGAINST CUTS

[76] Inventors: Johannes Adrianus Augstinus van Marwijk, Clematisstraat 110, 7591 XE Denekamp, Netherlands; Karlheinz Hupp, Churchillstraat 69, 7591 CW Denekamp, Netherlands

[21] Appl. No.: 817,276

[22] PCT Filed: Oct. 13, 1995

[86] PCT No.: PCT/EP95/04040

§ 371 Date: May 8, 1997

§ 102(e) Date: May 8, 1997

[87] PCT Pub. No.: WO96/11595

PCT Pub. Date: Apr. 25, 1996

[30] Foreign Application Priority Data

Oct. 14, 1994 [NL] Netherlands ..... 9401704

[51] Int. Cl.[6] ..... A41D 19/00

[52] U.S. Cl. ..... 2/16; 2/161.6; 2/162

[58] Field of Search ..... 2/2.5, 16, 162, 2/161.6, 158, 159, 123, 141.1, 141.2, 221, 167

[56] References Cited

U.S. PATENT DOCUMENTS

| | | | |
|---|---|---|---|
| 218,322 | 8/1879 | Schilling | 2/162 X |
| 470,170 | 3/1892 | Alderman | 2/162 X |
| 1,612,757 | 12/1927 | Wells | 2/162 |
| 2,344,080 | 3/1944 | Burgett | 2/162 |
| 4,388,733 | 6/1983 | Anstett | 2/167 |
| 4,471,495 | 9/1984 | Kruse et al. | 2/162 |
| 4,868,927 | 9/1989 | Bourdeau et al. | 2/162 X |
| 5,054,126 | 10/1991 | Rivkin | 2/161.6 |
| 5,113,526 | 5/1992 | Wang et al. | 2/2 |
| 5,511,241 | 4/1996 | Ziegler | 2/16 X |
| 5,704,066 | 1/1998 | Yamamoto | 2/161.6 |
| 5,729,831 | 3/1998 | Kuhlmann | 2/16 |

FOREIGN PATENT DOCUMENTS

| | | | |
|---|---|---|---|
| 1030 | of 1873 | United Kingdom | 2/162 |
| 12483 | of 1909 | United Kingdom | 2/162 |

*Primary Examiner*—Michael A. Neas

*Attorney, Agent, or Firm*—Jordan and Hamburg LLP

[57] ABSTRACT

The invention relates to a glove for protecting the hand against cuts, consisting of a lattice of interwoven rings, in particular of metallic rings, with at least one closure clement which is elastic.

13 Claims, 2 Drawing Sheets

GLOVE FOR PROTECTING THE HAND AGAINST CUTS

The invention relates to a glove for protecting the hand against cuts, consisting of a lattice of interwoven rings, in particular of metallic rings, with at least one closure element.

BACKGROUND OF THE INVENTION

Gloves of the aforementioned type for protecting the hand against cuts are used particularly in meat-processing plants as protection against injuries by, for example, cutting tools. Such gloves are known in short and long versions. In the first case, they extend as far as the wrist. In the second case, they extend as far as the forearm. For fastening the gloves, which are intended to protect the hand against cuts, at the wrist or at the arm, the construction of such protective gloves with closure elements is known. Conventionally, this is accomplished by sewing a nylon tape with a locking buckle on the lattice of interwoven rings. Alternately, it is also known that such nylon tape can be fixed with a snap fastener.

It is a disadvantage of these known gloves for protecting the hand against cuts that they must be adjusted each time by the user to the closure length required by the user. For protective gloves with a snap fastener closure, the individual length dimension of the closure frequently cannot be attained, so that only supplies of individually usable protective gloves can be kept in meat-processing plants. Furthermore, the known gloves, for protecting the hand against cuts, are not safe bacteriologically since, despite cleaning, residues of meat particles can adhere not only to the nylon tape itself, but also to the locking buckles and the snap fasteners. Moreover, the known protective gloves are provided at their side with an opening, in order to be able to close the glove at all. This can lead to unprotected regions of the hand, which is to be protected by the glove.

SUMMARY OF THE INVENTION

It is an object of the present invention to develop a protective glove of the aforementioned type further in such a manner, that it can be pulled on and closed in a simple and convenient manner.

To accomplish this objective the glove, for protecting the hand against cuts, is distinguished by the fact that the closure element is constructed elastically. By means of the elastically constructed closure clement, the glove, which is to protect the hand against cuts, can be slipped safely and easily over the hand and held automatically at the hand by the elastically constructed closure element. During the process of slipping on the glove, the closure element, provided under tension in the protective glove when the latter is not slipped over the hand, is expanded and changes over automatically into the stretched closed position after the protective glove is slipped on. The amount of expansion and the extent of the initial tension depend on such factors as the size of the hand and of the shoulder and/or the forearm of the user. A cumbersome adjustment to different closure lengths and a cumbersome closing are not required. The closure element itself may be formed by a spring element, an elastic tape and the like. Advisably, in this connection, the possibility of cleaning also the closure element effectively and simply should be taken into consideration. Preferably, therefore, a metallic spring element is provided at one or also at several places of the protective glove.

Furthermore, it is also possible to incorporate the elastic closure element directly in the lattice of interwoven rings, so that partial regions of the protective glove elastic. Moreover, it is also possible, either, for example, by a double layer construction of regions of the lattice of interwoven rings or also by turned-over end regions or by overlapping end regions, to provide receiving channels, in which the the elastic closure element can be inserted or disposed. Moreover, it is also possible, for example, to hook the elastic closure element in rings of the lattice of interlaced rings and thus to construct this element as a part that is to be handled separately. The elastic closure element can also be pulled through the rings of the metal lattice (slalom shaped, alternately on the inside and on the outside).

In all, a glove for protecting the hand against cuts is created therewith, which adjusts automatically to the hand dimensions or the arm dimensions of the user and can be cleaned effectively and simply. Likewise a protective glove is created therewith which, despite the individual, simple closure possibility, does not have to have any recesses or free regions, so that the hand of a user is protected effectively against injuries with this protective glove. The closure element itself is a part, which is exposed to significantly less wear because, compared to conventional closure elements, it should be disposed in a region protected by the lattice of interwoven rings and thus cannot be damaged by cutting tools. In order to be able to clean it effectively in mechanical cleaning equipment, the glove is furthermore provided with hangers, such as rings combined with the lattice of interwoven rings.

For a further explanation of the invention, reference is made to the accompanying claims, the drawing and the subsequent description.

DESCRIPTION OF THE PREFERRED EMBODIMENTS

Figure 4:
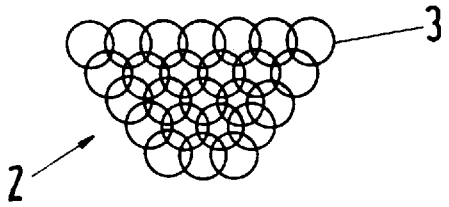
FIG. 4 shows a section of a representation of a lattice of interwoven rings of an inventive, protective glove.

The glove, which is to protect the hand against cuts and, as a whole, is labeled 1 in the drawing, consists of a lattice 2 of interwoven metallic rings 3, adjacent ones of which interlock. A section of the lattice 2 is shown in FIG. 4. The protective glove 1, which is shown in the drawing, is equipped with a hand region and a forearm region and, in the example shown, has two elastic closure elements 4, in each case in the form of a spring element of a metallic material. The number of turns is selected so that, although the elasticity aimed for can be realized, the turns do not lie so close to one another in the tensionless state that meat residue particles can be wedged. In the example shown, the elastic closure elements 4 are in each case disposed in a receiving channel 5. The receiving channel 5 is bounded on the inside by the lattice 2 of interwoven rings and on the outside also by a lattice of interwoven rings, so that the elastic closure element is disposed in a protected manner in the receiving channel.

Figure 1:
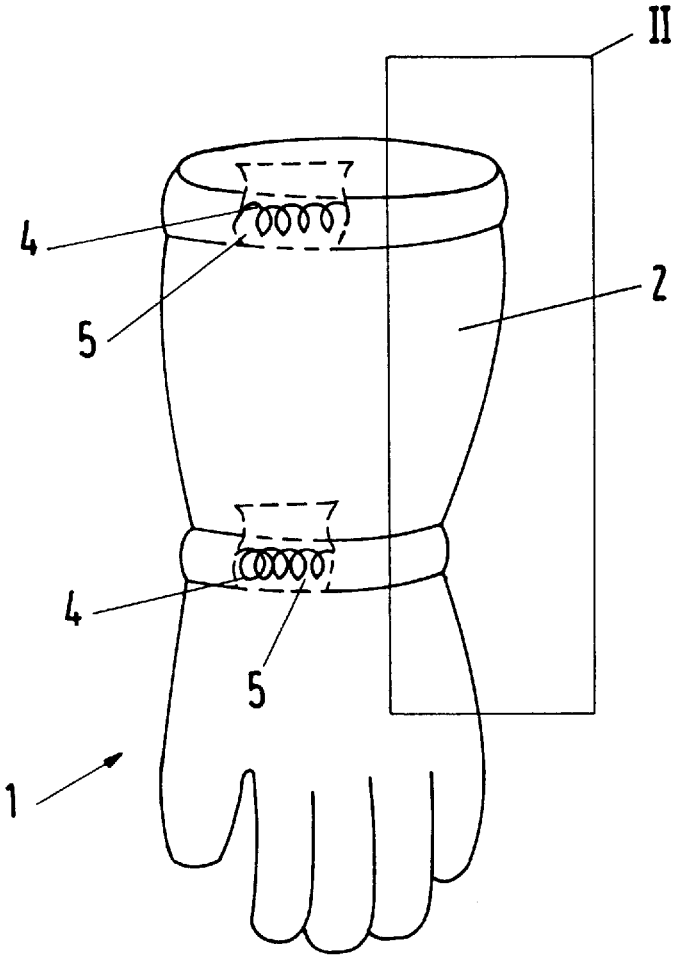
FIG. 1 shows a systematic representation of an example of an inventive glove, for protecting the hand against cuts.
Figure 2:
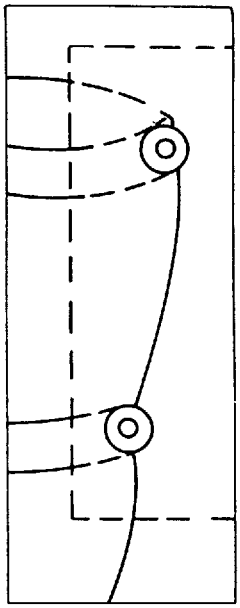
FIG. 2 shows the region of Section II of FIG. 1 on an enlarged scale.
Figure 3:
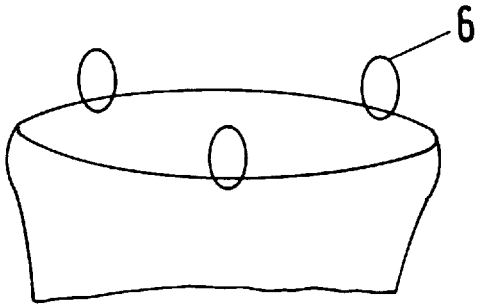
FIG. 3 shows a section of the upper end region of an example of the inventive, protective glove.

As indicated in FIG. 3, hangers 6 may also be provided in order to be able to suspend and subsequently clean the protective glove, for example, in automatically operating cleaning equipment. The inventive protective glove can be cleaned and freed from meat residues effectively with simple means. The closure element is disposed in a protected manner. The closure element adapts automatically to hand and arms of different thickness and size and holds the protective glove securely on the operator.

We claim:

1. A glove for protecting the hand against cuts comprising a lattice of interwoven metal rings, two receiving channels incorporated into and defining a partial region of the lattice of interwoven rings, elastic closure means disposed in each of said receiving channels to facilitate retaining the glove on a wearer's hands.

2. A glove according to claim 1 wherein said lattice of interwoven rings has an end portion, one of said receiving channels including turned-over end regions of the lattice of interwoven rings obtained by turning over said end portion.

3. A glove according to claim 1 wherein at least one of said receiving channels includes a double layer of said lattice of interwoven rings.

4. A glove according to claim 1 wherein said receiving channel includes said lattice of interwoven rings.

5. A glove according to claim 1 wherein said elastic closure means comprises a spring.

6. A glove according to claim 1 further comprising hangers on said lattice of interwoven gloves.

7. A glove according to claim 6 wherein said hangers are formed by rings connected with the lattice of interwoven rings.

8. A glove for protecting the hand against cuts according to claim 1 wherein at least one of said elastic closure means is a metal spring having a plurality of turns.

9. A glove according to claim 8 wherein said metal spring has a tensionless state, said turns being spaced from one another when said spring is in said tensionless state.

10. A glove for protecting the hand against cuts comprising a lattice of interwoven metal rings, a receiving channel in the lattice of interwoven rings, and a metal spring in said channel to facilitate retaining the glove on the wearer's hand.

11. A glove for protecting the hand against cuts according to claim 10 wherein said metal spring has a plurality of turns.

12. A glove according to claim 11 wherein said metal spring has a tensionless state, said turns being spaced from one another when said spring is in said tensionless state.

13. A glove for protecting the hand against cuts comprising a lattice of interwoven metal rings, a receiving channel in the lattice of interwoven rings, and a metal spring interlaced into the metal rings in said channel to facilitate retaining the glove on the wearer's hand.

* * * * *